US007673866B2

(12) United States Patent
Saitsu et al.

(10) Patent No.: US 7,673,866 B2
(45) Date of Patent: Mar. 9, 2010

(54) SHEET CONVEYING APPARATUS AND IMAGE FORMING SYSTEM

(75) Inventors: Yasushi Saitsu, Hachioji (JP); Tetsuo Hirata, Hachioji (JP); Motoki Nakamichi, Hachioji (JP); Norishige Kato, Hachioji (JP); Takehiro Ogushi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 526 days.

(21) Appl. No.: 11/643,337

(22) Filed: Dec. 20, 2006

(65) Prior Publication Data

US 2007/0170635 A1 Jul. 26, 2007

(30) Foreign Application Priority Data

Jan. 16, 2006 (JP) ..... 2006-007466

(51) Int. Cl.
*B65H 39/00* (2006.01)

(52) U.S. Cl. ..... 270/58.09; 270/58.01; 270/58.02; 270/58.04; 270/58.07; 270/58.08

(58) Field of Classification Search ..... 270/58.01, 270/58.02, 58.04, 58.07, 58.08, 58.09; 271/202
See application file for complete search history.

(56) References Cited

U.S. PATENT DOCUMENTS 5,690,324 A * 11/1997 Otomo et al. ..... 270/58.02
6,042,098 A * 3/2000 Kubota et al. ..... 270/58.02
2007/0009270 A1* 1/2007 Kawano et al. ..... 399/13
2007/0057445 A1* 3/2007 Miyake et al. ..... 271/256
2007/0164499 A1* 7/2007 Saitsu ..... 271/3.18

FOREIGN PATENT DOCUMENTS

JP 2006137538 A * 6/2006

* cited by examiner

*Primary Examiner*—Gene Crawford
*Assistant Examiner*—Leslie A Nicholson, III
(74) *Attorney, Agent, or Firm*—Squire, Sanders & Dempsey L.L.P.

(57) ABSTRACT

A sheet conveying apparatus is connected between an image forming apparatus and a post-processing apparatus to receive the sheet ejected from the image forming apparatus, and to eject the sheet to the post-processing apparatus. The sheet conveying apparatus receives, from the post-processing apparatus, a sheet reception line speed information showing a line speed for the post-processing apparatus to receive the sheet, and receives, from the image forming apparatus, a sheet ejection line speed information showing a line speed for the image forming apparatus to eject the sheet. A conveyance line speed control section controls the conveyance line speed at the time of receiving the sheet from the image forming apparatus based on a sheet ejection line speed information, and controls the conveyance line speed at the time of ejecting the sheet to the post-processing apparatus based on a sheet reception line speed information.

8 Claims, 6 Drawing Sheets

SHEET CONVEYING APPARATUS AND IMAGE FORMING SYSTEM

This application is based on Japanese Patent Application No. 2006-007466 filed on Jan. 16, 2006 in Japanese Patent Office, the entire content of which is hereby incorporated by reference.

BACKGROUND OF THE INVENTION

The present invention relates to a sheet conveying apparatus connected between an image forming apparatus such as a printer and a post-processing apparatus and to an image forming system.

There has been used a finisher as a post-processing apparatus that conducts post processing such as a punching process and a stapling process, and various types of speed adjusting device have been employed because a sheet conveyance speed of an image forming apparatus is usually higher than that for post processing. With respect to a speed adjustment manner, there are known, for example, a manner wherein a conveyance speed is synchronized between a printer and a finisher (Unexamined Japanese Patent Application Publication No. 2002-311659), a manner to cope with changes of the printer side conveyance speed at the finisher side (Unexamined Japanese Patent Application Publication No. 10-111585) and a manner to make a carry-in roller on the finisher side to be high in speed to conduct receipt at high speed and to adjust a conveyance speed inside the finisher (Unexamined Japanese Patent Application Publication No. 2000-62998) and there are further known a manner where a sheet interval is adjusted by the printer depending on a type of post processing for the post processing conducted for plural sheets (Unexamined Japanese Patent Application Publication No. 11-208979) and a manner to adjust the speed by utilizing stacking on an intermediate tray of the finisher (Unexamined Japanese Patent Application Publication No. 2001-72308).

Since a post-processing apparatus is generally designed and developed as an apparatus exclusive for an image forming apparatus to which the post-processing apparatus is connected, a huge amount of cost is required for development of the apparatus even when the post-processing apparatus is one conducting the same processing.

Therefore, in Unexamined Japanese Patent Application Publication No. 2004-26358, there is proposed a relay conveying apparatus that adjusts operating speeds for the image forming apparatus and the post-processing apparatus, so that a conventional post-processing apparatus may be connected to the image forming apparatus even when specifications of the image forming apparatus are changed.

However, the structure of the aforesaid relay conveying apparatus causes the apparatus to be large in size, which is a problem.

SUMMARY

A theme of the present invention is to enhance general versatility in connection between an image forming apparatus and a post-processing apparatus.

For solving the aforesaid theme, the present embodiment of the invention is a sheet conveying apparatus which is connected with an image forming apparatus and a post-processing apparatus therebetween, and which receives a sheet ejected from the image forming apparatus and conveys the sheet at a conveyance line speed to eject the sheet to the post-processing apparatus, the sheet conveying apparatus including: a first receiving section which receives, from the post-processing apparatus, a sheet reception line speed information indicating a line speed for the post-processing apparatus to receive the sheet; a second receiving section which receives, from the image forming apparatus, a sheet ejection line speed information indicating a line speed for the image forming apparatus to eject the sheet and a sheet size information with reference to each sheet to be ejected from the image forming apparatus; a storing section to store the sheet reception line speed information, the sheet ejection line speed information and the sheet size information; a calculating section for calculating timing for the image forming apparatus to eject the sheet with reference to each sheet based on the information stored in the storing section; a transmitting section for transmitting the timing information to the image forming apparatus; a conveyance line speed control section which controls the conveyance line speed at a time of receiving the sheet from the image forming apparatus based on the sheet ejection line speed information, and which controls the conveyance line speed at a time of ejecting the sheet to the post-processing apparatus based on the sheet reception line speed information.

Another present embodiment of the invention is an image forming system equipped with an image forming apparatus; a post-processing apparatus; and a sheet conveying apparatus which is connected with the image forming apparatus and the post-processing apparatus therebetween, and which receives a sheet ejected from the image forming apparatus and conveys the sheet at a conveyance line speed to eject the sheet to the post-processing apparatus, wherein the image forming apparatus includes a sheet ejection line speed information transmitting section which transmits, to the sheet conveying apparatus, a sheet ejection line speed information indicating a line speed for the image forming apparatus to eject the sheet and a sheet size information with reference to each sheet to be ejected from the image forming apparatus, the post-processing apparatus includes a sheet reception line speed information transmitting section which transmits, to the sheet conveying apparatus, a sheet reception line speed information indicating a line speed for the post-processing apparatus to receive the sheet, and the sheet conveying apparatus includes: a first receiving section which receives the sheet reception line speed information from the post-processing apparatus, a second receiving section which receives the sheet ejection line speed information and the sheet size information from the image forming apparatus, a storing section which stores the sheet reception line speed information, the sheet ejection line speed information and the sheet size information; a calculating section for calculating timing for the image forming apparatus to eject the sheet with reference to each sheet based on the information stored in the storing section; a transmitting section for transmitting the timing information; a conveyance line speed control section which controls the conveyance line speed at a time of receiving the sheet from the image forming apparatus based on the sheet ejection line speed information and which controls the conveyance line speed at a time of ejecting the sheet to the post-processing apparatus based on the sheet reception line speed information, and wherein the image forming apparatus further includes: a receiving section for receiving the timing information from the sheet conveying apparatus; and a control section for controlling the timing for each sheet based on the timing information.

DETAILED DESCRIPTION OF THE PREFERRED EMBODIMENT

First Embodiment

Figure 1:
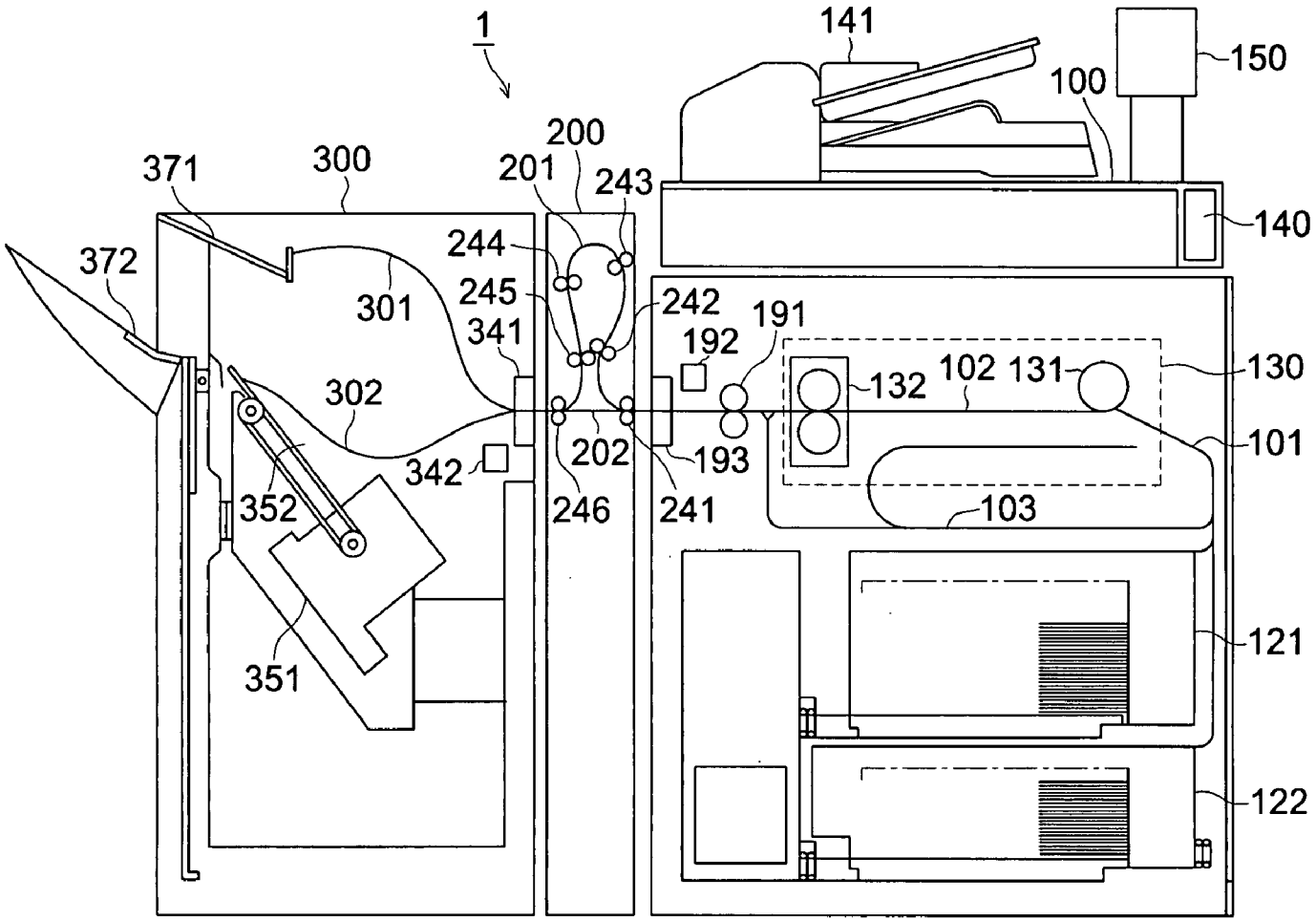
FIG. 1 is a schematic structural diagram of image forming system 1 in the first embodiment of the invention.

The first embodiment of the invention will be explained in detail as follows, referring to the drawings.

FIG. 1 shows a schematic structure of image forming system 1 in the first embodiment.

As shown in FIG. 1, the image forming system 1 is composed of image forming apparatus 100, sheet conveying apparatus 200 and post-processing apparatus 300.

The image forming apparatus 100 is equipped with sheet housing sections 121 and 122, image forming section 130, image reading section 140, automatic document conveying section 141, operating section 150, sheet-ejection rollers 191, sheet-ejection sensor 192 and sheet-ejection outlet 193. Further, on the image forming apparatus 100, there are provided, as a conveyance path for sheets, sheet supply path 101 for supplying sheets from sheet housing sections 121 and 122 to image forming section 130, conveyance path 102 starting from image forming section 130 to sheet-ejection outlet 193 through sheet-ejection rollers 191 and conveyance path for reverse side 103 where reversal conveyance is carried out.

Sheets having the same sheet type and the same sheet size are housed in each of the sheet housing sections 121 and 122.

In the image forming section 130, photoconductor 131 is scanned for the exposure by a laser beam that is emitted from an exposure section (not illustrated) based on image data, so that an electrostatic latent image is formed on the photoconductor 131. Then, toner is attached to the photoconductor 131 by a developing section (not illustrated), and the toner is transferred onto a sheet in a transfer section (not illustrated). Thus, an image is formed by fixing the toner thermally on the sheet in fixing section 132.

The image reading section 140 is a functional portion that reads a document as image data. Specifically, a reflected ray of light emitted from a light source and reflected on the document is read by a CCD (Charge Coupled Device) image sensor. When automatic document conveying section 141 is used, documents are conveyed to image reading section 140 one by one from a bundle of documents set on the automatic document conveying section 141, and images are read.

The operating section 150 is equipped with various types of keys including a numeric key and a start key. Further, the operating section 150 is equipped with a touch panel formed integrally with display sections such as LCD (Liquid Crystal Display), then, detects positions touched by fingertips of a user or a touch pen, and accepts instructions from a user.

Sheet-ejection rollers 191 convey the sheet on which an image has been formed to sheet-ejection outlet 193. Sheet-ejection sensor 192 is a sensor for detecting the presence of sheets, and it detects positions of a leading edge and a trailing edge of the sheet ejected from the sheet-ejection outlet 193.

Sheet conveying apparatus 200 is connected between image forming apparatus 100 and post-processing apparatus 300 to receive the sheet ejected from the image forming apparatus 100 and to eject the sheet to the post-processing apparatus 300. As shown in FIG. 1, sheet conveying apparatus 200 is equipped with sheet conveying rollers 241, 242, 243, 244, 245 and 246, and has two conveyance paths 201 and 202. The conveyance path 202 serves as a shortest course that connects the post-processing apparatus 300 and the image forming apparatus 100.

The post-processing apparatus 300 is equipped with accepting inlet 341, entrance sensor 342, staple processing section 351, stacker 352, fixed sheet-ejection tray 371 and elevating sheet-ejection tray 372. Further, on the post-processing apparatus 300, there are provided conveyance path 301 through which a sheet is ejected to the fixed sheet-ejection tray 371 and conveyance path 302 through which a sheet is ejected to the elevating sheet-ejection tray 372.

The entrance sensor 342 is a sensor for detecting the presence of sheets, and it detects positions of a leading edge and a trailing edge of the sheet conveyed in through the accepting inlet 341.

The staple processing section 351 conducts staple processing for a bundle of sheets whose number is a preset number stacked by stacker 352. A bundle of sheets which have been subjected to staple processing are ejected to the elevating sheet-ejection tray 372.

The stacker 352 stacks sheets conveyed through the conveyance path 302. When conducting sheet shift ejection in which some sheets are ejected after being shifted a little in position sideways, shift processing is conducted for a bundle of sheets conveyed to the stacker 352. The bundle of sheets subjected to shift processing is ejected to the elevating sheet-ejection tray 372.

Even in the case of a mode in which post-processing such as staple processing or shift processing is not conducted, sheets are ejected to the elevating sheet-ejection tray 372 through conveyance path 302, when a large amount of images are formed.

The fixed sheet-ejection tray 371 is a tray to which a sheet is ejected when images are formed on small number of sheets. The elevating sheet-ejection tray 372 is a tray that can move up and down depending on a thickness of a bundle of sheets to be ejected.

Figure 2:
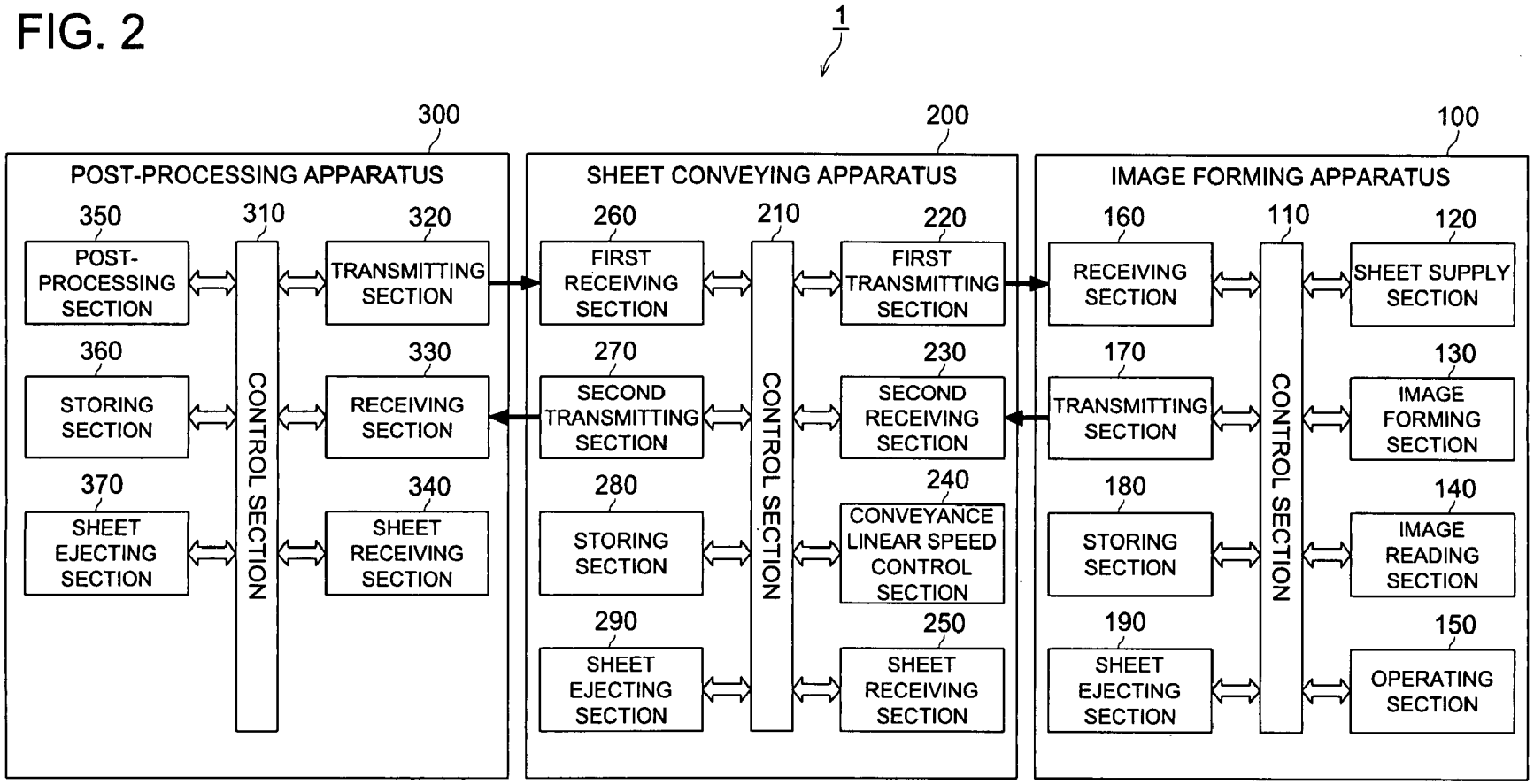
FIG. 2 is a block diagram showing functional structures of image forming apparatus 100, sheet conveying apparatus 200 and post-processing apparatus 300 all constituting image forming system 1.

FIG. 2 is a block diagram showing functional structures of image forming apparatus 100, sheet conveying apparatus 200 and post-processing apparatus 300 all constituting image forming system 1. Incidentally, an explanation of the structure explained in FIG. 1 will be omitted.

As shown in FIG. 2, the image forming apparatus 100 is equipped with control section 110, sheet supply section 120, image forming section 130, image reading section 140, operating section 150, receiving section 160, transmitting section 170, storing section 180 and with sheet ejecting section 190.

The control section 110 controls various sections of the image forming apparatus 100 on an overall control basis in accordance with instructions inputted from the operating section 150 or from the receiving section 160. The control section 110 is equipped with CPU (Central Processing Unit), ROM (Read Only Memory) and RAM (Random Access Memory), and CPU reads programs stored in ROM, then, develops them on a work area in RAM and conducts various processes together with programs.

The sheet supply section 120 supplies sheets housed in sheet housing sections 121 and 122 to the image forming section 130.

The receiving section 160 receives data from sheet conveying apparatus 200. For example, at the time of power-on, the receiving section 160 receives information of a post processing type showing a type of post processing that is practicable in post-processing apparatus 300 (punching process, folding process and stapling process) from sheet conveying apparatus 200.

The transmitting section 170 transmits data to the sheet conveying apparatus 200. For example, at the time of forming images, the transmitting section 170 transmits sheet ejection line speed information showing sheet ejection line speed $V_1$ of image forming apparatus 100, sheet type information (sheet size and basis weight) and image forming information (color and monochrome) to the sheet conveying apparatus 200. The sheet ejection line speed of the image forming apparatus 100 means a line speed at the time of sheet ejection by the image forming apparatus 100.

The storing section 180 stores data to be used in various types of processes conducted by the image forming apparatus 100 and data generated from various types of processes conducted by the image forming apparatus 100.

The sheet ejecting section 190 controls sheet-ejection rollers 191, and ejects the sheet on which an image is formed through sheet-ejection outlet 193.

As shown in FIG. 2, the sheet conveying apparatus 200 is equipped with control section 210, first transmitting section 220, second receiving section 230, conveyance line speed control section 240, sheet receiving section 250, first receiving section 260, second transmitting section 270, storing section 280 and with sheet ejecting section 290.

The control section 210 controls various sections of the sheet conveying apparatus 200 on an overall control basis. The control section 210 is equipped with CPU, ROM and RAM, and CPU reads programs stored in ROM, then, develops them on a work area in RAM and conducts various types of processes together with the programs.

In the sheet conveying apparatus 200, the sheet is usually set to be conveyed through conveyance path 201. When sheet ejection line speed $V_1$ of the image forming apparatus 100 is the same as sheet reception line speed $V_3$ of post-processing apparatus 300, the control section 210 switches the conveyance path for the sheet to conveyance path 202. The sheet reception line speed of the post-processing apparatus 300 is a line speed at the time of receiving the sheet of the post-processing apparatus 300.

The first transmitting section 220 transmits data to the image forming apparatus 100. For example, the first transmitting section 220 transmits information of post-processing types to the image forming apparatus 100 at the time of power-on.

The second receiving section 230 receives data from the image forming apparatus 100. For example, at the time of image forming, the second receiving section 230 receives sheet ejection line speed information ($V_1$), information of sheet types, and image forming information from the image forming apparatus 100. Incidentally, the second receiving section 230 receives sheet ejection line speed information for each sheet ejected from the image forming apparatus 100.

The first receiving section 260 receives data from post-processing apparatus 300. For example, the first receiving section 260 receives, from the post-processing apparatus 300, sheet reception line speed information showing sheet reception line speed $V_3$ of the post-processing apparatus 300 and information of types of post processes, at the time of power-on.

The second transmitting section 270 transmits data to the post-processing apparatus 300. For example, at the time of image forming, the second transmitting section 270 transmits information of sheet types and information of image forming to the post-processing apparatus 300.

The conveyance line speed control section 240 controls sheet conveying rollers 241, 242, 243, 244, 245 and 246, and controls the conveyance line speed of a sheet. Specifically, the conveyance line speed control section 240 controls the conveyance line speed at the time of receiving a sheet from the image forming apparatus 100 based on sheet ejection line speed information ($V_1$), and controls the conveyance line speed at the time of ejecting a sheet to the post-processing apparatus 300 based on sheet reception line speed information ($V_3$).

The sheet receiving section 250 receives a sheet ejected from image forming apparatus 100.

The storing section 280 stores data to be used in various types of processing carried out by sheet conveying apparatus 200 and data generated by various types of processing carried out by sheet conveying apparatus 200. The storing section 280 stores sheet ejection line speed information ($V_1$) and sheet reception line speed information ($V_3$).

The sheet ejecting section 290 ejects the conveyed sheet to the post-processing apparatus 300.

As shown in FIG. 2, the post-processing apparatus 300 is equipped with control section 310, transmitting section 320, receiving section 330, sheet receiving section 340, post-processing section 350, storing section 360 and sheet ejecting section 370.

The control section 310 controls various sections of the post-processing apparatus 300 on an overall control basis. The control section 310 is equipped with CPU, ROM and RAM, and CPU reads programs stored in ROM, then, develops them on a work area in RAM and conducts various types of processes together with the programs.

The transmitting section 320 transmits data to the sheet conveying apparatus 200. For example, the transmitting section 320 transmits information of sheet reception line speed ($V_3$) and information of post-processing types to the sheet conveying apparatus 200 at the time of power-on.

The receiving section 330 receives data from the sheet conveying apparatus 200. For example, at the time of image forming, the receiving section 330 receives sheet type information and image forming information from sheet conveying apparatus 200.

The sheet receiving section 340 receives the sheet ejected from the sheet conveying apparatus 200.

The post-processing section 350 is equipped with a punching process section (not shown), a folding process section (not shown), stapling process section 351 and stacker 352, and conducts punching process, folding process and stapling process for the sheet which is received from the sheet conveying apparatus 200.

The storing section 360 stores data to be used for various types of processes carried out by the post-processing apparatus 300 and data generated by various types of processes carried out by the post-processing apparatus 300.

The sheet ejecting section 370 ejects a sheet to fixed sheet-ejection tray 371 or to elevating sheet-ejection tray 372.

Next, operations in the first embodiment will be explained.

Figure 3:
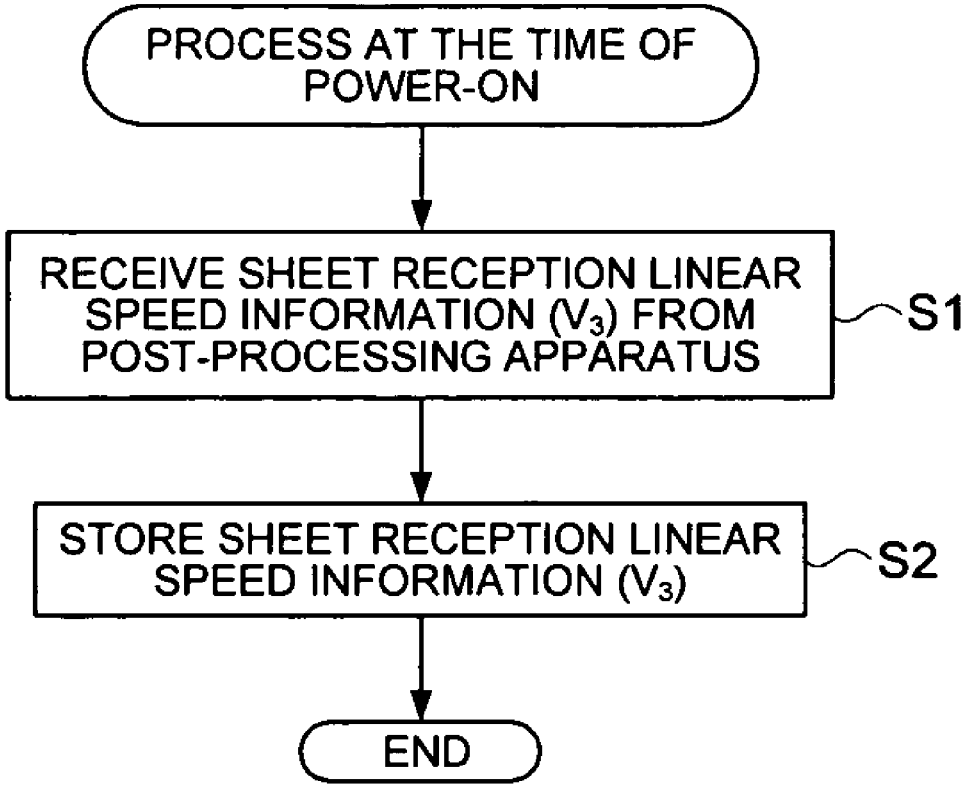
FIG. 3 is a flow chart showing process at the time of power-on in the first embodiment.

FIG. 3 is a flow chart showing process at the time of power-on carried out by sheet conveying apparatus 200.

First, when the power for image forming system 1 is turned on, sheet reception line speed information ($V_3$) is transmitted from transmitting section 320 of the post-processing apparatus 300 to the sheet conveying apparatus 200. In the sheet conveying apparatus 200, the sheet reception line speed information ($V_3$) is received by the first receiving section 260 from the post-processing apparatus 300 (step S1) to be stored in storing section 280 (step S2).

Through the foregoing, process at the time of power-on is terminated.

When-sheet ejection line speed $V_1$ of the image forming apparatus 100 is not the same as sheet reception line speed $V_3$ of the post-processing apparatus 300, control section 210 calculates sheet interval $T_2$ as timing for image forming apparatus 100 to eject a sheet, based on sheet ejection line speed $V_1$ and sheet reception line speed $V_3$. The sheet interval $T_2$ is a minimum sheet interval (time) required to relay the sheet conveyance from the image forming apparatus 100 to the post-processing apparatus 300 in sheet conveying apparatus 200.

First transmitting section 220 transmits the sheet interval information showing the sheet interval $T_2$ to the image forming apparatus 100.

Receiving section 160 receives sheet interval information ($T_2$) from sheet conveying apparatus 200.

Control section 110 controls an interval for ejecting a sheet based on the sheet interval information ($T_2$).

Figure 4:
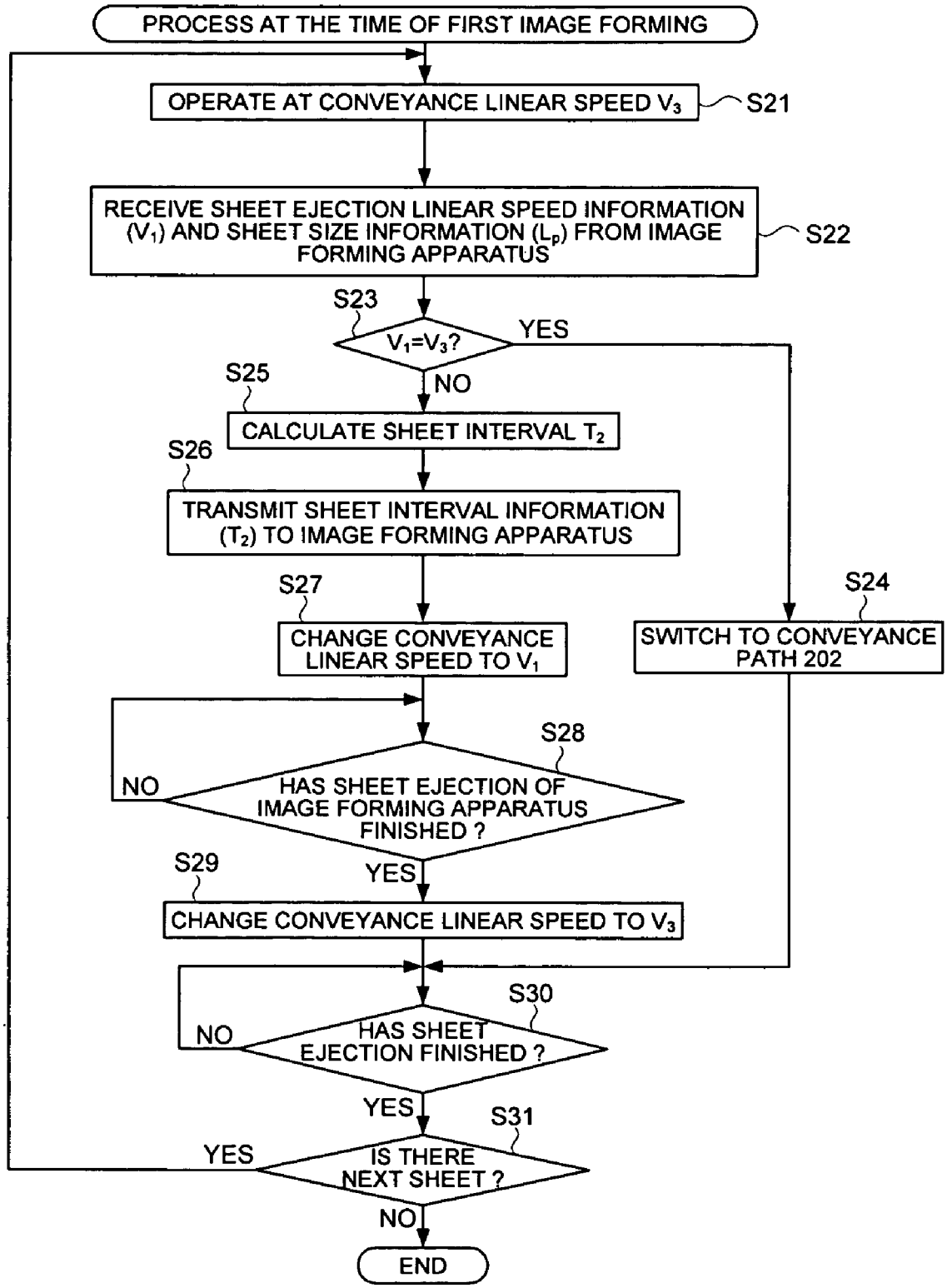
FIG. 4 is a flow chart showing process at the time of first image forming in the first embodiment.

FIG. 4 is a flow chart showing process at the time of first image forming in the first embodiment.

First, when image forming is started on image forming apparatus 100, sheet conveying apparatus 200 is controlled by conveyance line speed control section 240 to operate at the conveyance line speed identical to sheet reception line speed $V_3$ (step S21).

Immediately before the sheet is fed from sheet, supply section 120 of the image forming apparatus 100 to image forming section 130, sheet ejection-line speed information ($V_1$) and sheet size information showing sheet size $L_p$ are transmitted from transmitting section 170 of the image forming apparatus 100 to sheet conveying apparatus 200. The sheet size $L_p$ means a length of the sheet in its conveyance direction ejected from the image forming apparatus 100. In the sheet conveying apparatus 200, sheet ejection line speed information ($V_1$) and sheet size information ($L_p$) are received by the second receiving section 230 from the image forming apparatus 100 (step S22), to be stored in storing section 280.

When sheet ejection line speed $V_1$ of the image forming apparatus 100 is the same as sheet reception line speed $V_3$ of the post-processing apparatus 300 in this case (step S23; Yes), the conveyance path is switched to conveyance path 202 (step S24), and the flow advances to step S30.

When sheet ejection line speed $V_1$ of the image forming apparatus 100 is different from sheet reception line speed $V_3$ of the post-processing apparatus 300 in step S23 (step S23; No), sheet interval $T_2$ is calculated based on the sheet ejection line speed $V_1$ and the sheet reception line speed $V_3$ (step S25).

Figure 5:
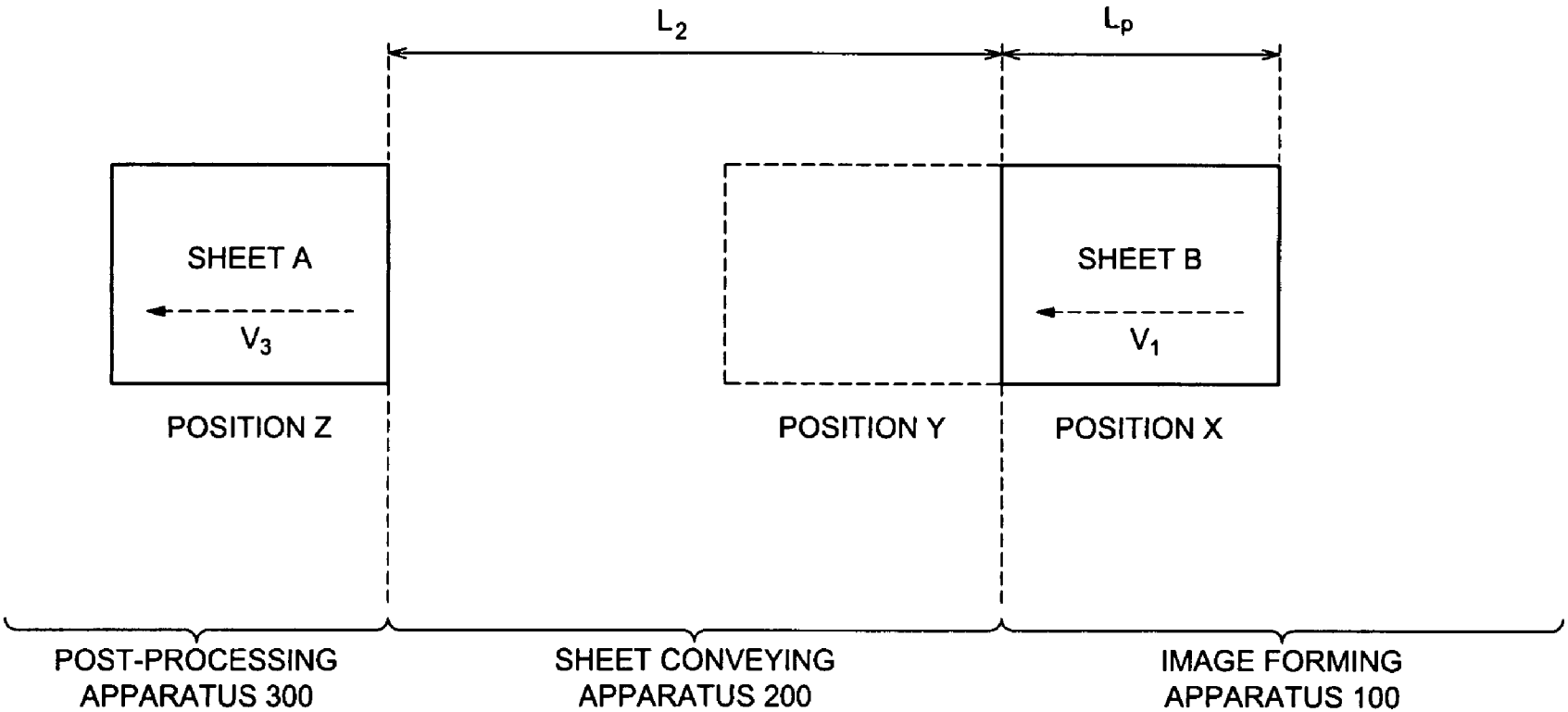
FIG. 5 is a diagram for illustrating a method of calculation of sheet interval $T_2$.

How to calculate sheet interval $T_2$ will be explained, referring to FIG. 5.

Sheet conveying apparatus 200 ejects preceding sheet A at conveyance line speed $V_3$, and changes a conveyance line speed to $V_1$ to become capable of receiving succeeding sheet B. In other words, sheet interval $T_2$ (time) required between sheet A and sheet B is the sum total of the time required for conveying the sheet from position X to position Y at conveyance line speed $V_1$ in FIG. 5, the time required for conveying the sheet from position Y to position Z at conveyance line speed $V_3$ and the time required for restoring the conveyance line speed from $V_3$ to $V_1$.

Therefore, sheet interval $T_2$ minimally required for the sheet conveying apparatus 200 to relay the sheet conveyance is expressed by $T_2=(L_p/V_1)+(L_2/V_3)+t$, under the assumption that $L_p$ represents a length of the sheet in its conveyance direction, $L_2$ represents a total length of the conveyance path of the sheet conveying apparatus 200 and t represents the time required for restoring the conveyance line speed from $V_3$ to $V_1$.

Next, sheet interval information ($T_2$) is transmitted by first transmitting section 220 to the image forming apparatus 100 (step S26). In the image forming apparatus 100, sheet interval information ($T_2$) is received by receiving section 160, and the interval for ejecting the sheet is controlled by control section 110 based on the sheet interval information ($T_2$). Specifically, if the sheet interval $T_2$ calculated at sheet conveying apparatus 200 is longer than an ordinary sheet-supply interval in image forming apparatus 100, sheet supply from sheet supply section 120 to image forming apparatus 130 is to be delayed so that a sheet supply interval may become $T_2$.

After step S26, a conveyance line speed is changed by conveyance line speed control section 240 to be the same as sheet ejection line speed $V_1$ in terms of a value (step S27).

Then, the sheet ejected from the image forming apparatus 100 at sheet ejection line speed $V_1$ is received by sheet receiving section 250 of the sheet conveying apparatus 200. When a trailing edge of the sheet to be ejected is detected by sheet-ejection sensor 192 of the image forming apparatus 100, namely, when sheet ejection from the image forming apparatus 100 has been completed (step S28; Yes), a conveyance line speed is changed by conveyance line speed control section 240 to become the same as sheet reception line speed $V_3$ in terms of a value (step S29). Incidentally, the condition of "(length of conveyance path 201 of sheet conveying apparatus 200)≧(length in the conveyance direction of maximum sheet size that can be processed by image forming system 1)+(distance required for line speed change)" needs to be satisfied, because a change of conveyance line speed needs to be finished by the moment when a leading edge of a sheet is ejected from the sheet conveying apparatus 200.

After step S29 or step S24, it is judged whether the sheet ejection from the sheet conveying apparatus 200 to post-processing apparatus 300 has been completed or not (step S30). The completion of the sheet ejection at the sheet conveying apparatus 200 is judged by entrance sensor 342 of the post-processing apparatus 300 based on whether a trailing edge of the sheet is detected or not. If sheet ejection is completed to post-processing apparatus 300 in sheet conveying apparatus 200 (step S30; Yes), the presence of the sheet to be ejected next is judged (step S31). When the next sheet is in existence (step S31; Yes), the flow returns to step S22, and sheet ejection line speed information ($V_1$) and sheet size information ($L_p$) for the next sheet are received so that processes for step S22-Step S31 are repeated.

When the next sheet is not in existence in step S31 (step S31; No), process at the time of first image forming is terminated.

The sheet ejected from the sheet conveying apparatus 200 is received by the post-processing apparatus 300 at sheet reception line speed $V_3$, and it is subjected to post-processing, to be ejected.

Image forming system in the first embodiment makes it possible for the sheet to be received at the conveyance line speed suitable for the image forming apparatus 100 at the sheet conveying apparatus 200 and to be ejected at the conveyance line speed suitable for post-processing apparatus 300, which can enhance general versatility in connection between the image forming apparatus 100 and the post-processing apparatus 300. Therefore, it is possible to connect any post-processing apparatus 300 even when specifications of the image forming apparatus 100 are changed.

When sheet ejection line speed $V_1$ of the image forming apparatus 100 is not the same as sheet reception line speed $V_3$ of the post-processing apparatus 300, timing (sheet interval $T_2$) for the image forming apparatus 100 to eject the sheet based on sheet ejection line speed $V_1$ and sheet reception line speed $V_3$ is calculated. Therefore, general versatility in connection between the image forming apparatus 100 and the post-processing apparatus 300 can be enhanced.

Further, for each sheet ejected from the image forming apparatus 100, it is possible to control the conveyance line speed at the time of receiving a sheet from the image forming apparatus 100 based on sheet ejection line speed information ($V_1$) for each sheet.

Further, when sheet ejection line speed $V_1$ of the image forming apparatus 100 is the same as sheet reception line speed $V_3$ of the post-processing apparatus 300, namely, when no change of the conveyance line speed is needed, a sheet can be conveyed through conveyance path 202 that is shorter in terms of distance than conveyance path 201.

Second Embodiment

Next, the second embodiment to which the invention is applied will be explained.

An image forming system in the second embodiment is the same in terms of structure as image forming system 1 shown in the first embodiment. Accordingly, the same constituent portions are given the same symbols, and illustrations and explanations for the structures are omitted. Characteristic structures and processes of the second embodiment will be explained as follows.

When transmitting section 170 transmits sheet ejection line speed information ($V_1$) and sheet type information (sheet size and basis weight) to the sheet conveying apparatus 200 in the course of image forming, it also transmits simultaneously execution post-processing type information showing post processing F (punching process, folding process or stapling process) that is instructed by a user and is to be carried out.

When second receiving section 230 receives sheet ejection line speed information ($V_1$) and sheet type information from image forming apparatus 100 in the course of image forming, it also receives simultaneously execution post-processing type information (F).

Second transmitting section 270 transmits execution post-processing type information (F) received from the image forming apparatus 100 to post-processing apparatus 300.

Receiving section 330 receives execution post-processing type information (F) from sheet conveying apparatus 200.

Post-processing required time $T_3$ required for conducting each post-processing is stored in storing section 360 of post-processing apparatus 300 in advance.

Transmitting section 320 transmits post-processing required time information showing post-processing required time $T_3$ that corresponds to execution post-processing type information (F) to sheet conveying apparatus 200.

First receiving section 260 receives post-processing required time information ($T_3$) corresponding to execution post-processing type information (F) from post-processing apparatus 300.

Control section 210 calculates sheet interval T as timing for image forming apparatus 100 to eject a sheet, based on post-processing required time $T_3$, sheet ejection line speed $V_1$ and sheet reception line speed $V_3$. The sheet interval T is a minimum sheet interval (time) required as a total image forming system.

First transmitting section 220 transmits sheet interval information showing sheet interval T to image forming apparatus 100.

Receiving section 160 receives sheet interval information (T) from sheet conveying apparatus 200.

Control section 110 controls intervals for ejecting sheets based on sheet interval information (T).

Next, operations in the second embodiment will be explained.

Processes at the time of power-on of the image forming system in the second embodiment are the same as those at the time of power-on explained in the first embodiment, and explanation for them will be omitted here accordingly.

Figure 6:
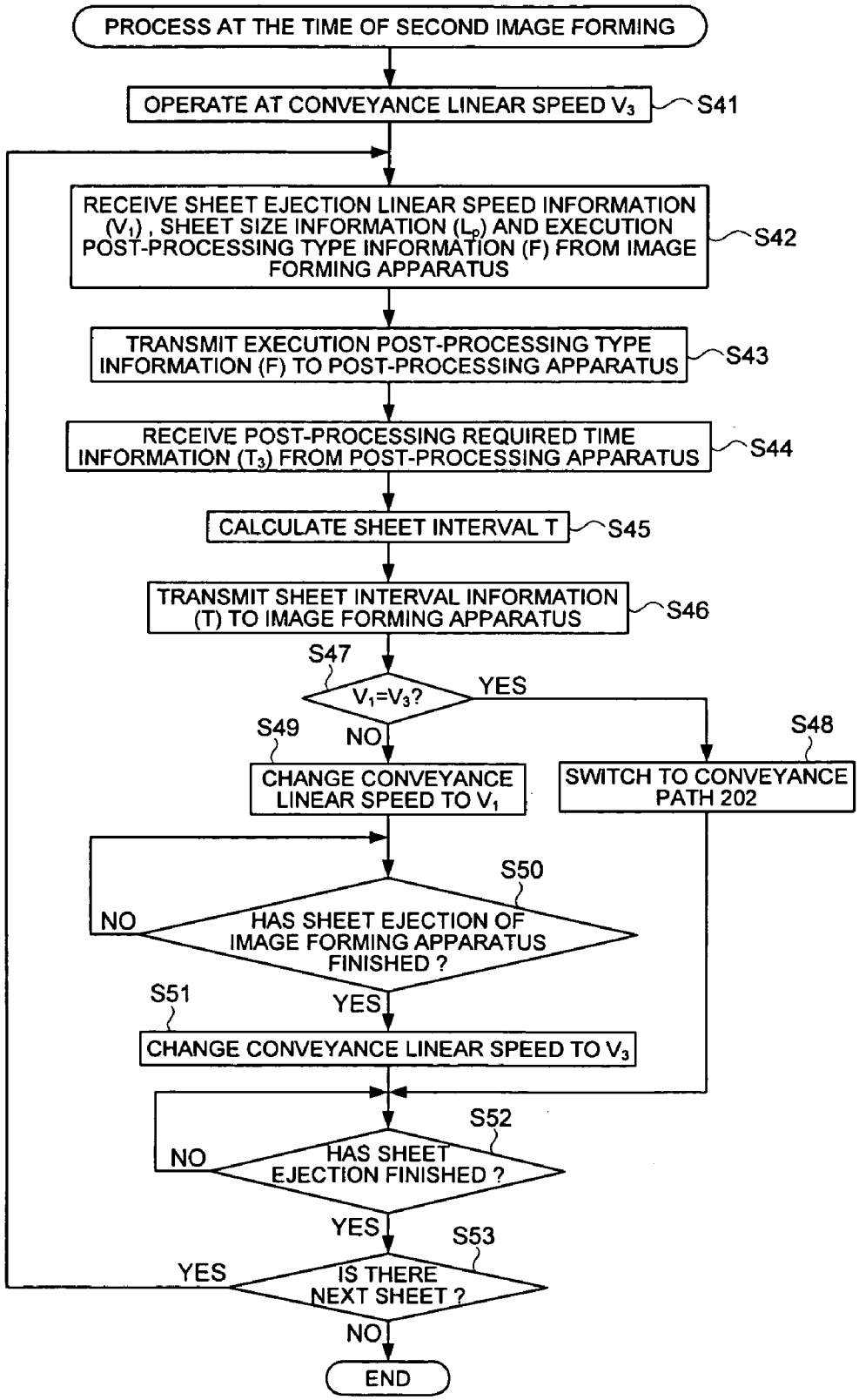
FIG. 6 is a flow chart showing process at the time of second image forming in the second embodiment.

FIG. 6 is a flow chart showing process at the time of second image forming in the second embodiment.

First, when image forming is started on image forming apparatus 100, sheet conveying apparatus 200 is controlled by conveyance line speed control section 240 to operate at the conveyance line speed identical to sheet reception line speed $V_3$ (step S41).

Immediately before the sheet is fed from sheet supply section 120 of the image forming apparatus 100 to image forming section 130, sheet ejection line speed information ($V_1$), sheet size information ($L_p$) and execution post-processing type information (F) are transmitted from transmitting section 170 of the image forming apparatus 100 to sheet conveying apparatus 200. In the sheet conveying apparatus 200, sheet ejection line speed information ($V_1$), sheet size information ($L_p$) and execution post-processing type information (F) are received by the second receiving section 230 (step S42), and are stored in storing section 280. Then, the execution post-processing type information (F) is transmitted to post-processing apparatus 300 (step S43).

In the post-processing apparatus 300, post-processing required time information ($T_3$) corresponding to execution post-processing type information (F) is transmitted by transmitting section 320 to sheet conveying apparatus 200. In the sheet conveying apparatus 200, post-processing required time information ($T_3$) is received by the first receiving section 260 from the post-processing apparatus 300 (step S44), and is stored in the storing section 280.

Next, based on post-processing required time $T_3$, sheet ejection line speed $V_1$ and sheet reception line speed $V_3$, sheet interval T minimally required as a total image forming system is calculated (step S45).

First, in the same way as in the first embodiment, sheet interval $T_2$ minimally required for the sheet conveying apparatus 200 to relay the sheet conveyance is calculated. Then, this sheet interval $T_2$ is compared with the post-processing required time $T_3$ received from the post-processing apparatus 300, and the greater value resulted from the comparison is made to be sheet interval T.

Next, sheet interval information (T) is transmitted by the first transmitting section 220 to image forming apparatus 100 (step S46). In the image forming apparatus 100, sheet interval information (T) is received by receiving section 160, and intervals for ejecting sheets based on the sheet interval information (T) are controlled by control section 110. Specifically, if the sheet interval T calculated at sheet conveying apparatus 200 is longer than an ordinary sheet-supply interval in image forming apparatus 100, sheet supply from sheet supply section 120 to image forming apparatus 130 is to be delayed so that a sheet-supply interval may become T.

If the sheet ejection line speed $V_1$ of image forming apparatus 100 is the same as sheet reception line speed $V_3$ of post-processing apparatus 300 (step S47; Yes), the conveyance path is switched to conveyance path 202 (step S48), and the flow advances to step S52.

In step S47, when sheet ejection line speed $V_1$ of the image forming apparatus 100 is different from the sheet reception line speed $V_3$ of post-processing apparatus 300 (step S47; No), a conveyance line speed is changed by conveyance line speed control section 240 to the value identical to sheet ejection line speed $V_1$ (step S49).

Then, the sheet ejected from the image forming apparatus 100 at sheet ejection line speed $V_1$ is received by sheet receiving section 250 of sheet conveying apparatus 200. When a trailing edge of the sheet ejected is detected by sheet-ejection sensor 192 of the image forming apparatus 100, namely, when sheet ejection from the image forming apparatus 100 is completed (step S50; Yes), the conveyance line speed is changed by conveyance line speed control section 240 to the value that is the same as sheet reception line speed $V_3$ (step S51).

After step S51 or step S48, if sheet ejection is completed to post-processing apparatus 300 in sheet conveying apparatus 200 (step S52; Yes), it is judged whether the sheet to be ejected is in existence or not (step S53). When the succeeding sheet is in existence (step S53; Yes), the flow returns to step S42, and processes for step S42-step S53 are repeated.

When the succeeding sheet is not in existence (step S53; No) in step S53, process at the time of second image forming is terminated.

An image forming system in the second embodiment makes it possible for the sheet to be received at the sheet conveying apparatus 200 at the conveyance line speed suitable for image forming apparatus 100, and to be ejected at the conveyance line speed suitable for post-processing apparatus 300, which can enhance general versatility in connection between the image forming apparatus 100 and the post-processing apparatus 300.

Further, a value of minimum sheet interval $T_2$ that is calculated based on sheet ejection line speed $V_1$ and sheet reception line speed $V_3$ and is minimally required by sheet conveying apparatus 200 to relay sheet conveyance, or a value of post-processing required time $T_3$ corresponding to execution post-processing type information (F), whichever is greater is made to be timing (sheet interval T) for image forming apparatus 100 to eject a sheet. It is therefore possible to enhance general versatility in connection between the image forming apparatus 100 and the post-processing apparatus 300.

Incidentally, the aforesaid description in each embodiment is an example of an image forming system relating to the invention, to which, however, the invention is not limited. Even in the case of detailed structures and detailed operations for each apparatus constituting the system, they may be varied without departing from the spirit and scope of the invention.

For example, although two conveyance paths 201 and 202 are provided on sheet conveying apparatus 200 in each of the aforesaid embodiments, three or more conveyance paths may also be provided.

Further, in the sheet conveying apparatus 200, it is also possible to make a data form of information received from image forming apparatus 100 and a data form of information received from post-processing apparatus 300 to be capable of being replaced with each other, and thereby to transmit information received from image forming apparatus 100 to post-processing apparatus 300, and to transmit information received from post-processing apparatus 300 to image forming apparatus 100.

The embodiment of the invention makes it possible to receive a sheet at a conveyance line speed that is suitable for the image forming apparatus and to eject the sheet at a conveyance line speed that is suitable for the post-processing apparatus, which can enhance general versatility in connection between an image forming apparatus and a post-processing apparatus.

The embodiment of the invention makes it possible to control the conveyance line speed at the time of receiving the sheet from the image forming apparatus based on a sheet ejection line speed information in accordance with each sheet.

The embodiment of the invention makes it possible to enhance general versatility in connection between an image forming apparatus and a post-processing apparatus, because timing for the image forming apparatus to eject the sheet is calculated.

The embodiment of the invention makes it possible to calculate timing for the image forming apparatus to eject a sheet based on a line speed for the image forming apparatus to eject a sheet and on a line speed for the post-processing apparatus to receive the sheet.

The embodiment of the invention makes it possible to calculate timing for the image forming apparatus to eject a sheet based on a period of time required for post-processing in the post-processing apparatus.

The embodiment of the invention makes it possible to convey the sheet through the shortest conveyance path, when a change in the conveyance line speed is not needed.

What is claimed is:

1. A sheet conveying apparatus which is connected with an image forming apparatus and a post-processing apparatus therebetween, and which receives a sheet ejected from the image forming apparatus and conveys the sheet at a conveyance line speed to eject the sheet to the post-processing apparatus, the sheet conveying apparatus comprising:

a first receiving section which receives, from the post-processing apparatus, a sheet reception line speed information indicating a line speed for the post-processing apparatus to receive the sheet;

a second receiving section which receives, from the image forming apparatus, a sheet ejection line speed information indicating a line speed for the image forming apparatus to eject the sheet and a sheet size information with reference to each sheet to be ejected from the image forming apparatus;

a storing section to store the sheet reception line speed information, the sheet ejection line speed information and the sheet size information;

a calculating section for calculating timing for the image forming apparatus to eject the sheet with reference to each sheet based on the information stored in the storing section;

a transmitting section for transmitting the timing information to the image forming apparatus;

a conveyance line speed control section which controls the conveyance line speed at a time of receiving the sheet from the image forming apparatus based on the sheet ejection line speed information, and which controls the conveyance line speed at a time of ejecting the sheet to the post-processing apparatus based on the sheet reception line speed information.

2. The sheet conveying apparatus of claim 1, wherein the calculating section calculates the timing based on time required for post-processing in the post processing apparatus.

3. The sheet conveying apparatus of claim 1, further comprising:

at least two conveyance paths;

a switching section for switching the conveyance paths;

wherein the switching section switches to the shortest path when the sheet ejection line speed is same as the sheet reception line speed.

4. The sheet conveying apparatus of claim 1, wherein the calculating section calculates sheet interval $T_2$ minimally required for the sheet conveying apparatus to relay sheet conveyance which is expressed by $T_2=(L_p/V_1)+(L_2/V_3)+t$, under an assumption that $L_p$ represents a length of the sheet in a conveyance direction of the sheet, $V_1$ represents sheet ejection line speed of the image forming apparatus, $L_2$ represents a total length of a conveyance path of the sheet conveying apparatus, $V_3$ represents sheet reception line speed of the post-processing apparatus and t represents time required for restoring the conveyance line speed from $V_3$ to $V_1$.

5. An image forming system comprising:

an image forming apparatus;

a post-processing apparatus; and a sheet conveying apparatus which is connected with the image forming apparatus and the post-processing apparatus therebetween, and which receives a sheet ejected from the image forming apparatus and conveys the sheet at a conveyance line speed to eject the sheet to the post-processing apparatus, wherein the image forming apparatus includes a sheet ejection line speed information transmitting section which transmits, to the sheet conveying apparatus, a sheet ejection line speed information indicating a line speed for the image forming apparatus to eject the sheet and a sheet size information with reference to each sheet to be ejected from the image forming apparatus, the post-processing apparatus includes a sheet reception line speed information transmitting section which transmits, to the sheet conveying apparatus, a sheet reception line speed information indicating a line speed for the post-processing apparatus to receive the sheet, and the sheet conveying apparatus includes:

a first receiving section which receives the sheet reception line speed information from the post-processing apparatus, a second receiving section which receives the sheet ejection line speed information and the sheet size information from the image forming apparatus, a storing section which stores the sheet reception line speed information, the sheet ejection line speed information and the sheet size information;

a calculating section for calculating timing for the image forming apparatus to eject the sheet with reference to each sheet based on the information stored in the storing section;

a transmitting section for transmitting the timing information;

a conveyance line speed control section which controls the conveyance line speed at a time of receiving the sheet from the image forming apparatus based on the sheet ejection line speed information and which controls the conveyance line speed at a time of ejecting the sheet to the post-processing apparatus based on the sheet reception line speed information, and wherein the image forming apparatus further includes:

a receiving section for receiving the timing information from the sheet conveying apparatus; and a control section for controlling the timing for each sheet based on the timing information.

6. The image forming system of claim 5, wherein the calculating section calculates the timing based on time required for post-processing in the post processing apparatus.

7. The image forming system of claim 5, wherein the sheet conveying apparatus comprises:

at least two conveyance paths;

a switching section for switching the conveyance paths;

wherein the switching section switches to the shortest path when the ejection line speed is same as the reception line speed.

8. The image forming system of claim 5, wherein the calculating section calculates sheet interval $T_2$ minimally required for the sheet conveying apparatus to relay sheet conveyance which is expressed by $T_2=(L_p/V_1)+(L_2/V_3)+t$, under an assumption that $L_p$ represents a length of the sheet in a conveyance direction of the sheet, $V_1$ represents sheet ejection line speed of the image forming apparatus, $L_2$ represents a total length of a conveyance path of the sheet conveying apparatus, $V_3$ represents sheet reception line speed of the post-processing apparatus and t represents time required for restoring the conveyance line speed from $V_3$ to $V_1$.

* * * * *